United States Patent [19]

Tilles

[11] 4,389,798

[45] Jun. 28, 1983

[54] ATHLETIC SHOE

[76] Inventor: Harvey G. Tilles, P.O. Box 5466, 614 N. Hamilton, High Point, Guilford, N.C. 27262

[21] Appl. No.: 261,887

[22] Filed: May 8, 1981

[51] Int. Cl.[3] ..... A43B 5/00; A43B 13/04

[52] U.S. Cl. ..... 36/129; 36/32 R

[58] Field of Search ..... 36/129, 4, 32 R, 59 R, 36/126, 128, 127, 114, 30

[56] References Cited

U.S. PATENT DOCUMENTS

| | | | |
|---|---|---|---|
| Re. 27,512 | 10/1972 | Onitsuka | 36/114 |
| 1,455,887 | 5/1923 | Salisbury | 36/95 |
| 1,962,526 | 6/1934 | Riddell | 36/59 R |
| 2,552,601 | 5/1951 | Supple | 36/32 R |
| 2,847,769 | 8/1958 | Schlesinger | 36/127 |
| 2,855,704 | 10/1958 | Schlesinger | 36/127 |
| 2,959,874 | 11/1960 | Schlesinger | 29/577 R |
| 3,290,801 | 12/1966 | Bente | 36/129 |
| 3,971,145 | 7/1976 | Stegerwald | 36/32 R |
| 4,045,888 | 9/1977 | Oxenberg | 36/127 |
| 4,096,649 | 6/1978 | Saurwein | 36/95 |
| 4,132,016 | 1/1979 | Vaccari | 36/114 |
| 4,134,220 | 1/1979 | Dassler | 36/30 R |
| 4,167,071 | 9/1979 | Koransky | 36/127 |
| 4,180,924 | 1/1980 | Subotnick | 36/129 |
| 4,259,792 | 4/1981 | Halberstadt | 36/129 |

FOREIGN PATENT DOCUMENTS 263576 7/1968 Austria .

*Primary Examiner*—Patrick D. Lawson

*Attorney, Agent, or Firm*—Samuel Meerkreebs

[57] ABSTRACT

An athletic shoe particularly adapted for use in sports where sudden turns, starts, stops and lateral movements are involved, in which the sole 14 includes a lengthwise concavity 46 for gripping action; the medial aspect 54 of the sole is linear and rouned off from about the first metatarsal extension up to and including the heel; the sole includes a two-tiered construction from the first metatarsal phalangal joint to distal at 58 to the fifth metatarsal head at 60 so a lowered area at 64 casts the user's weight forwardly to assist in sudden starts; the lateral edge 52 of the sole comprises a projecting wing 90 from the generally vertical side of the shoe; the heel is flared on the lateral edge and a projecting wing 72 is provided from behind the fifth metatarsal to just below the malleolus and around the heel to meet the aforementioned medial wing; and the posterior aspect of the sole is beveled; the shoe having a wrapped around construction on the exterior affording support for the user's foot.

13 Claims, 8 Drawing Figures

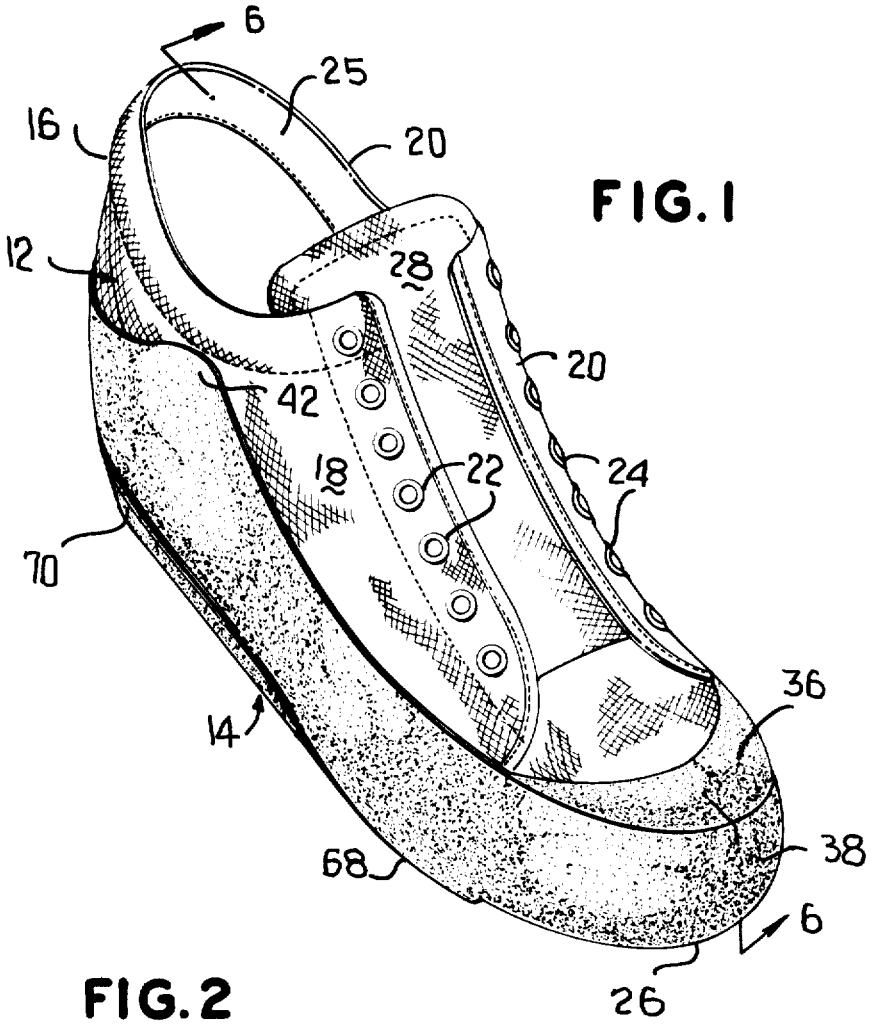
FIG. 1
FIG. 2
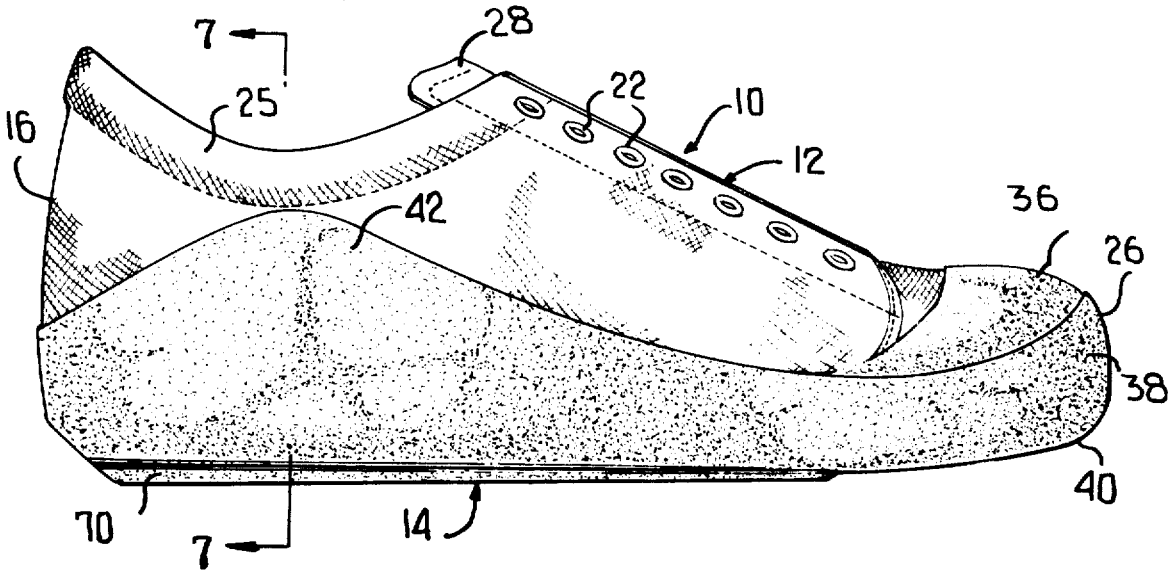

FIG.6
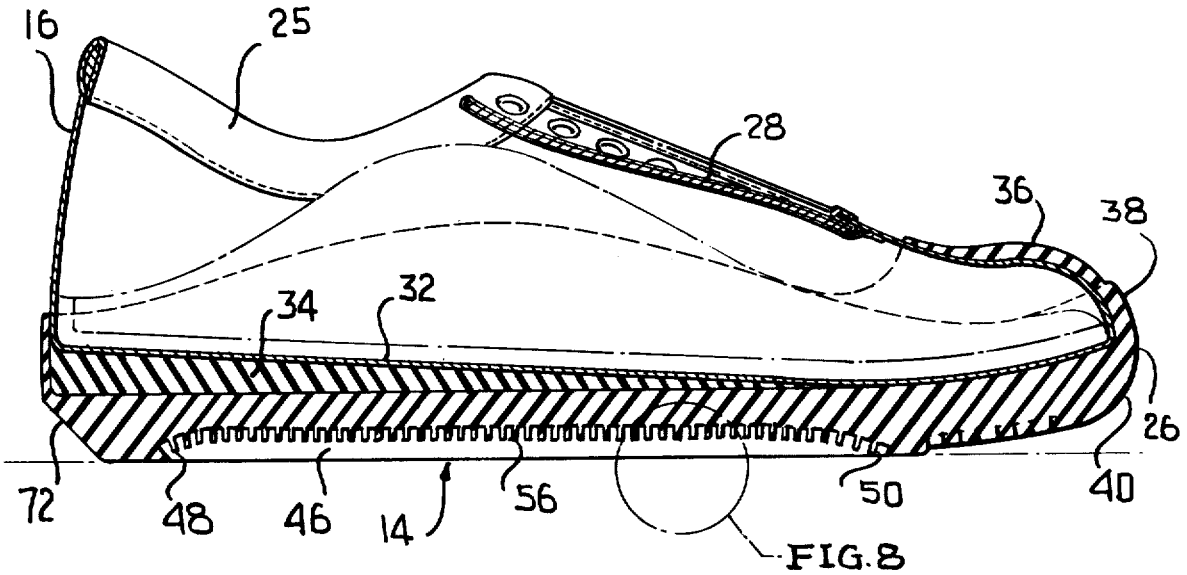
FIG.7
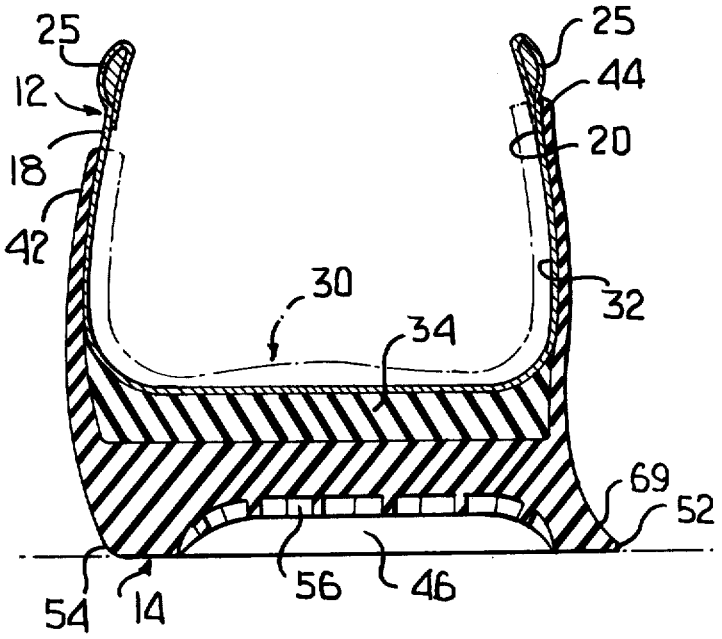
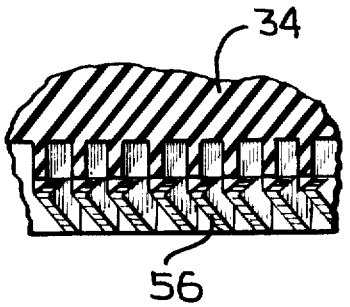
FIG.8

ATHLETIC SHOE

BACKGROUND OF THE INVENTION

Athletic shoes used in lateral motion sports tend to have taken a back seat to the development of athletic shoes used in the jogging or running sports; the needs of some athletes, be they amateur or professional, seem to have been neglected, particularly with respect to the sports of basketball, physical training, tennis, handball, racquetball and the like. These sports, contrary to running and jogging, involve sudden stops and starts, sudden lateral and backward movements, which movements often require much greater conditioning and body control than merely moving forward.

The athletic shoe art is highly developed and athletic shoes have become a considerable investment; however, many athletic shoes, although having an attractive appearance, fail to afford means to assist and protect the athlete's foot and ankles, particularly where sudden movements other than straight forward, are involved.

THE PRIOR ART

A typical recent running shoe is illustrative, where the patent to Subbotnick (U.S. Pat. No. 4,180,924) is generally concerned with maximum ground contact during pronation to obviate impact-caused injuries; in the patent to Stegerwald (U.S. Pat. No. 3,971,145), another relatively recent development, the patentee is primarily concerned with sole-wear in the inside ball-of-the-foot area as is the patentee Dassler in U.S. Pat. No. 4,134,220. In golf shoes such as those shown in the patents to Schlesinger, U.S. Pat. Nos. 2,487,769, 2,855,704 and 2,959,874, the patentee was concerned with distribution of weight of the golfer when assuming his stance to address the ball, resulting in correct positioning of the feet and affording maximum impact during weight shifting, and this patentee also recognized that by properly sloping the shoe sole, the weight of the wearer will be disposed to enable the golfer, during a swing, to "push off" from the ball of the rear foot. However, the facility of walking, or swinging a golf club, does not duplicate the radical and sudden movements encountered in racket sports, handball and the like; in these later sports, tremendous forces, torques and strains are placed on the athletes feet.

The ability to have shoes readily grip the playing surface was recongnized by the use of concavities in the bottom surface of the athletic shoes of Riddle (U.S. Pat. No. 1,962,526) or Saurwein (U.S. Pat. No. 4,096,649), while flexibility of the shoe sole is illustrated by the patent to Supple, (U.S. Pat. No. 2,552,601), or reinforcements by the patent to Onitsuka (U.S. Pat. No. Re. 27,512). The utilization of padding, sole groving, etc., for the purpose of playing street hockey, for example, as illustrated by the patent to Oxenberg (U.S. Pat. No. 4,045,888) does not go to protect the foot from torque and forces to which the ankle and foot are subjected, particularly while participating in this active sport.

BASIC OVERVIEW OF THE ANATOMY OF THE FOOT

The foot is comprised of the tarsal bones; calcaneous (heel), talus, with the lower ends of the fibular (lateral) and the tibia (medial) comprise the ankle joint, scaphoid or astragulus (keystone of the longitudinal arch), cuboid and 3 cuneiforms. Just distal to the tarsal bones are 5 metatarsal bones, and distal to these are 14 phalanges; 3 each of the lesser toes and 2 for the great toe.

The ankle joint, as mentioned, is comprised of the talus and the 2 amlleolis of the tibia and fibular—the ligamentous arrangements consist of anterior (front), posterior (rear), lateral (outside or away from midline of the body), and medial (towards midline of the body) ligaments. The ankle joint is a synovial, i.e., hinge joint.

Muscles: There are 13 leg muscles that originate on the lower leg and insert into the foot; 4 anterior, 2 lateral and 7 posterior. All of these muscles cross the ankle joint. There is one (1) intrinsic muscle on the dorsum of the foot. There are 4 layers of muscles on the plantar (bottom) of the foot; first layer—3 muscles, second layer—8 muscles, third layer—4 muscles, fourth layer—7 muscles and 2 tendons.

Arches of the Foot: Longitudinal: medial aspect of the foot. Posterior pillar is the calcaneous anterior pillar which consist of naviscular, cuneiforms—first three metatarsals medially; cuboid and last 2 metatarsals laterally transverse medial to lateral, composed of all these bones.

Arches maintained by muscles and tendons around the foot are primarily tibulis posterior and peroneous longus. Ligamentous support by the ligaments and the plantar fascia.

Function:

(1) Distribute weight, spring and elasticity;

(2) Shock absorbency; and (3) Space for soft tissue on plantar aspect.

SUMMARY OF THE INVENTION

The objects of the invention are:

to provide an athletic shoe which is constructed and arranged to permit sudden maximum normal pronation, i.e., lateral, forward and rearward movements of the participating athlete with minimum danger of injury and maximum, instantaneous movement due to proper weight orientation and distribution;

more particularly, to provide in combination, a novel shoe including a feathered edge from the distal end of the great toe to the distal of the fifth metatarsal head so that the foot, when striking the surface, creates a propulsive or pushing off which assists the athletes starts;

further, at the medial aspect of the sole, provide a rounded portion from the first metatarsal extension up to and including the head for permitting the wearer of the shoe to achieve maximum pronation at the rounded medial edge;

also, having the medial rounded edge extending linearly from the ball of the foot to the heel and extending from just above the ball of the great toe joint to the scaphold and continuing around the heel, thus bringing the shoe and foot in full contact with the surface and supporting the plantar arch while the foot is in maximum pronation;

in addition, providing a lateral, 90° edge limiting forcible inverting of the user's foot for deterring sprained ankles and tearing of the ligaments during sudden inversion and obviating sprained ankles;

and providing a flared lateral edge from behind the fifth metatarsal to just below the lateral malleolus and around the heel of the shoe to meet the medial wing as an additional deterrent of foot inversion while running backwards and laterally;

beveling the posterior aspect of the sole facilitating quick rollover into normal pronation and increasing dorsiflexion of the foot;

and providing with all of the features above, a longitudinal concavity along the undersurface of the sole of the novel shoe to improve its gripping action.

BRIEF DESCRIPTION OF THE DRAWINGS

Further objects and advantages will become evident from the following description of a preferred, but not an exclusive, embodiment of the novel athletic shoe, shown by way of non-limiting example only in the accompanying drawings, in which:

FIG. 1 is a perspective view looking into the lateral side of a right shoe incorporating the invention;

FIG. 2 is a side elevational view looking at the near side of FIG. 1;

FIG. 6 is a longitudinal sectional view taken substantially on the plane of line 6—6 of FIG. 1;

FIG. 7 is a transverse sectional view taken substantially on the plane of line 7—7 of FIG. 2; and FIG. 8 is an enlarged, fragmentary section of the circled portion so designated in FIG. 6.

DESCRIPTION OF A PREFERRED EMBODIMENT

Figure 3:
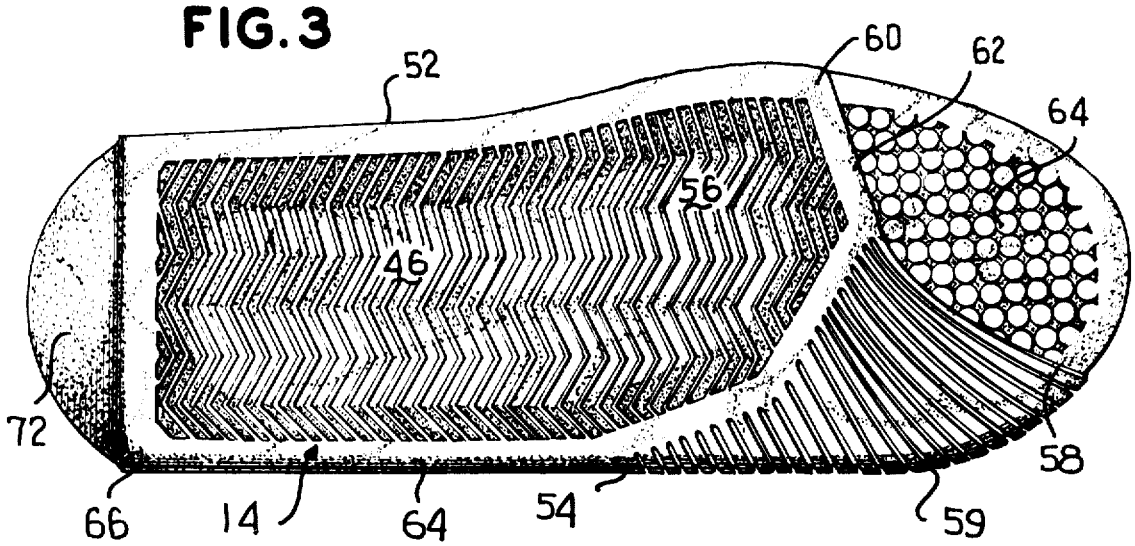
FIG. 3 is a bottom plan view of the shoe of FIG. 1.

With reference to the figures, the shoe according to the invention is indicated generally at 10 and including an upper portion 12 and sole portion 14. The upper and sole are assembled according to conventional molding and assembling procedures, and the upper portion 12 includes a heel portion 16 integral with the lateral and medial side portions 18 and 20, respectively, having suitable lace openings 22 and 24, respectively. As in the illustrated embodiment, conventional padding 25 will be incorporated in the upper around the upper, ankle-engaging portion. The toe construction of the illustrated shoe is the open-toed or "bloucher" style; however, the invention is equally adapted for use on the lace-to-the-toe type athletic shoe. The toe portion 26 is suitably reinforced and continues in a suitable padded tongue 28 flanked on opposite sides by the lateral and medial side wall edges.

The upper portion 12 is constructed from woven natural cotton threads, leather, or the like, and conventional adhesives; curing practices will be utilized. Likewise, the sole may be constructed from synthetics or natural rubbers, and the general assembly of the interior and sole are seen in FIGS. 6 and 7.

Referring to FIGS. 6 and 7, the details of the sole construction and inner laminations are best seen; an inner sole having suitable arch support is indicated by phantom lines at 30 in FIG. 7. The shoe includes a shoe-sock 32 overlying a wedge-shaped cushioning element or portion 34. The toe 26 of the shoe is suitably reinforced at 36 above the toe area, and at the forward portion, a thickened reinforcement 38 is provided which has a lower, rounded edge 40 as seen in FIG. 6. As is apparent from FIGS. 1, 2 and 4–7, the sole is integral with the toe reinforcement all the way around the heel, and thus wraps completely around from toe, sides and heel and comprises an essentially rigid material and at both the lateral and medial side portions, an arcuate extension 42 and 44, respectively, is provided.

The wrap-around feature provides substantial rigidity around the foot, protecting it in its encasement; with this encasement, the necessity for severe foot taping is substantially reduced, thus permitting good blood circulation which is often impaired by improper, unskilled taping. With the shoe properly fitted, the foot is essentially immobilized therewithin except for the free movement of the users toes in the shoe, similar to the fit of ski boots, for example.

Referring to the sole portion 14, in order to afford suction and good gripping, the sole includes a longitudinal concavity 46 extending substantially from the heel portion at 48 up to about the ball of the foot at 50. The concavity 46 terminates inwardly of the lateral and medial lower side edge 52 and 54, respectively, of the sole; see FIG. 7. The inner surface of the concavity 46 includes a plurality of ribs 56 which provide flexibility to the sole in the concavity area.

As seen in FIGS. 3–5 and 7, the sole includes a two-tiered or two-layered construction which is about ⅛ inch thick and feathered from about the distal to the first metatarsal phalangeal joint to distal at 58 to the first metatarsal phalangeal joint to distal to the fifth metatarsal head at 60; see FIG. 3. These portions are generally connected along an arcuate margin 62 and define forwardly thereof at 64 a lowered area or plateau which concentrates the weight at the big toe of the wearer, thus forcing the foot to first strike the first metatarsal joint, initially, to create a greater propulsive force forward and assisting during initial "push-off". This is the type of weight distribution attempted to achieve by tennis players, for example, where during receipt of a serve, they are constantly "shuffling their feet"; the purpose being to maintain the weight of the player forwardly on the ball of his feet to enable instantaneous "push-off". The raised portion is essentially beneath the big toe, thus the shoe sole construction positions the weight of the user over the big toe or forward and toward the medial or inner edge of the sole so that the user's weight is not back on his heels and fast starts are assisted.

Next, when "pushing-off" the medial edge 52, i.e., when moving laterally, many athletes find their movement impaired in a new pair of shoes, while after the shoes are worn, broken in, or almost ready to be discarded, they seem to be able to move better laterally. In the present novel sole, the inner or medial edge is linear as seen in FIG. 3, and is radiused or rounded, as seen in FIG. 3, whereby ready rotation or pronation about or over this edge is permitted. Not only is the normal pronation permitted, but since the rounded aspect extends from just above the great toe joint at 59 to the scaphold at 64 and back to the side of the heel at 66, this configuration, during lateral movement, brings the shoe in full contact with a support surface and supports the plantar arch during this rotation over the edge, while permitting the foot to have maximum normal pronation. It will be recalled, that through the wrap around, rigidity outside the shoe, the foot is essentially encased as is a skiers foot, i.e., minimum movement of the foot is accompanied by maximum support during sudden changes of direction.

Figure 4:
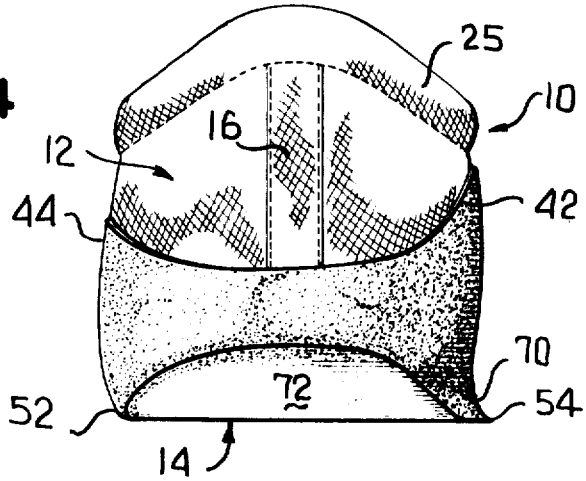
FIG. 4 is a rear elevational view of the shoe.
Figure 5:
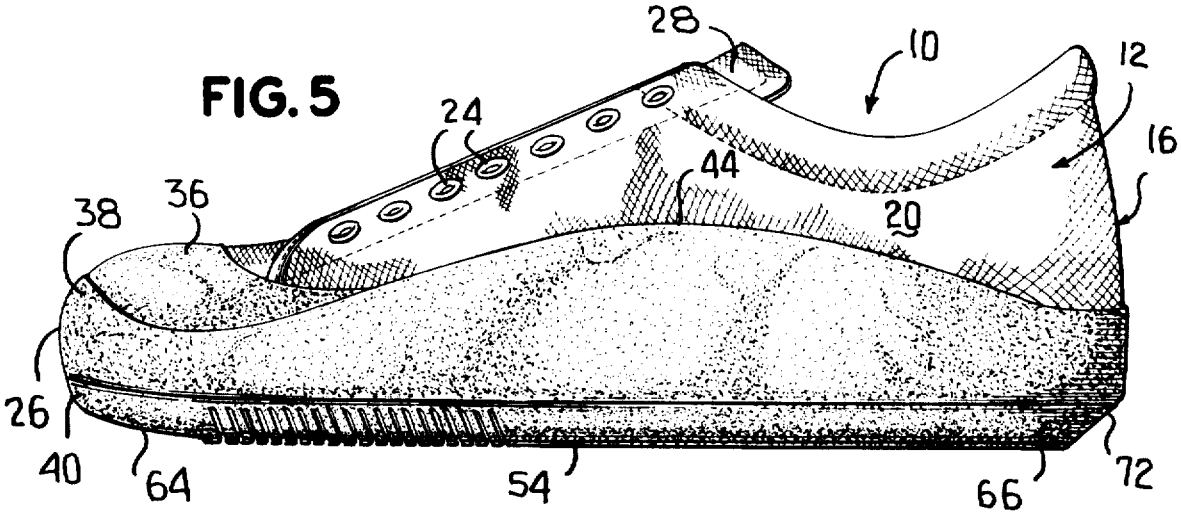
FIG. 5 is a side elevational view of the side of the shoe opposite that shown in FIG. 2 and showing the medial side of the shoe.

The lateral edge 52 of the shoe is also unique; it will be seen in FIGS 1, 4 and 7 there is afforded a lateral wing 69 substantially displaced outwardly of the vertical plane of the side portion 20; and this essentially provides an outrigger effect which tends to limit the foot from forcibly inverting over the lateral edge 52 and accordingly, limits tearing of the ligaments resulting in sprained ankles. This flaring is also afforded in the heel area as indicated at 70, thus providing a wing portion from behind the fifth metatarsal to just below the lateral malleolus and around the heel to meet the medial wing portion 69; this later flaring together with the medial flaring 68 increases, in a tactile sense, the lateral aspect of the foot of the user which is another factor on preventing ankle sprains.

Additionally, the posterior aspect of the sole is beveled at 72; this not only permits normal pronation, but increases dorsiflexion of the foot.

The wedge-shaped cushioning portion 34 is about one-half inch thick and tapers forwardly; extending from the heel to just behind the metatarsal heads; this being in the interior of the shoe; this functionally shortens the calf muscle which reduces Achilles-tendonitis and also serves to bring the fore-foot into more immediate contact with the ground while causing extension of the sole of the users foot at the first metatarsal phalangeal joint.

IN REVIEW

Bearing in mind the movements involved in racket sports and/or in handball, basketball and the like, it will be appreciated that very few, if any, shoes in the past appreciate the tremendous torques, twisting and strain, placed upon the athletes foot. Perhaps, the types of stress and strain was known by earlier manufacturers; however, the cost of production of earlier "sneakers" was so low, that the manufacturer could not afford to engineer the shoe properly; thus, in the past, the athlete has to be in super condition and depend primarily on brute strength and conditioning to overcome many of the stresses and strains.

The shoe of the present invention protects the more average athlete and provides full foot support through all motions, and particularly, during radical, lateral movements, while minimizing forcible inverting at the lateral edge which results in ankle sprains. Not only is the foot encouraged to achieve normal pronation about the medial edge, but the foot is fully supported during this movement along the arch; and the two-layered construction throws the weight onto the big toe or forwardly toward the ball of the foot; a normal position of the users foot when using the invention which encourages immediate and rapid starts.

The foregoing describes a preferred embodiment of the invention and is sufficient to enable others, skilled in the art, to practice, make, use and sell the same; however, it will be obvious to those skilled in the art that various changes may be made therein without departing from the invention, and it is the intention of the Applicant to claim such changes and modifications as fall within the true spirit and scope of the invention.

I claim

1. In an athletic shoe comprising an upper portion integral with a sole portion, said upper portion including medial and lateral side portions integral with corresponding medial and lateral side portions of said sole portion, said upper portion including a heel portion and toe portion integral with corresponding portions of said sole portion, and said upper portion including means for securing a user's foot in said shoe, the improvement comprising:

the medial aspect of the sole portion being linear and radiused at least from the ball of the foot toward the heel and beneath and the extent of the plantar arch for permitting the entire medial edge to readily rotate and support the user's foot during maximum pronation over said medial edge.

2. The structure as claimed in claim 1 in which the radiused medial aspect extends from just above the great toe joint to the scaphold and continues through to the heel whereby the shoe and foot therein are in full contact with a support surface and maximum support is provided for the plantar arch during pronation.

3. The structure as claimed in claim 1 in which the lateral edge of the sole portion extends substantially beyond the lateral side portion of the upper portion of the shoe, the heel portion of the sole portion including a lateral projection from behind and fifth metatarsal to just below the lateral malleous and around the heel to meet the extending portion of the lateral edge of the sole and providing essentially an outrigger for preventing foot-inversion during running laterally or backward and increasing in a tactile sense the lateral aspect of the foot for aiding to prevent sprained ankles.

4. The structure as claimed in claim 1 in which the posterior aspect of the sole in the heel area is beveled for affording quick rollover and increased dorsiflexion of the foot.

5. The structure as claimed in claim 1 in which said shoe includes a wedge-shaped cushioning portion tapering forwardly from the heel portion and overlying said sole portion, said wedge portion extending from the heel to just behind the metatarsal head within the shoe for functionally shortening the calf muscle of a user of the shoe to reduce Achilles-tendenitis, causing extension of the sole of the user's foot at the first metatarsal phalangeal joint for immediate ground contact.

6. The structure as claimed in claim 1 in which said sole portion includes in its lower surface a longitudinal concavity inwardly of the respective medial and lateral edges of the sole and extending from the heel portion to adjacent the ball of the foot.

7. The structure as claimed in claim 6 in which said concavity includes a plurality of transverse ribs therewithin and increasing the longitudinal flexibility of the sole at said concavity for promoting suction and gripping of the sole.

8. The structure as claimed in claim 1 in which said sole portion includes as integral projection extending upwardly to an intermediate portion of both the medial and lateral side portions of the shoe and generally at opposite sides of the respective plantar and metatarsal arch areas, said integral projection extending around the heel portion of the shoe upper.

9. The structure as claimed in claim 1 in which the sole includes an essentially two-tiered construction feathered from about the first metatarsal phalangeal to the fifth metatarsal head along a transverse margin and defining forwardly thereof a lowered area for concentrating a user's weight forwardly and essentially on the ball of the foot.

10. In an athletic shoe comprising an upper portion integral with a sole portion, said upper portion including lateral and medial side portions integral with lateral and medial sole portions said upper portion including a heel portion and a toe portion integral with corresponding portions of said sole portion, said upper portion including means for securing a user's foot in said shoe, the improvement comprising:

the medial aspect of the sole portion being in a single plane, linear from about the ball of the foot to substantially adjacent the heel area for providing substantial full linear contact along the linear sole edge in a single plane with a support surface and supporting a user's foot along the long plantar arch during placement of the foot and imposition of the user's weight thereon.

11. The structure as claimed in claimed in claim 10 in which said sole portion includes an integral portion extending upwardly to an intermediate portion of the exterior of said shoe upper portion and providing exterior arch support at least at the long plantar arch area.

12. The structure as claimed in claim 10 in which said upwardly extending portion has an upper, arcuate margin conforming substantially to the long plantar arch area above the sole and exteriorally of the shoe upper.

13. The structure as claimed in claim 10 in which said sole has extending vertically therefrom and at least around the heel area of the upper a rigid wrap-around structure which provides external rigid support at the shoe counter and extends forwardly therefrom.

* * * * *